US005592842A

United States Patent [19]

Nyrhilä

[11] Patent Number: 5,592,842

[45] Date of Patent: Jan. 14, 1997

[54] METHOD AND DEVICE FOR SHAPING DETAILS BY MEANS OF SUPERPLASTIC FORMING

[75] Inventor: Olli J. Nyrhilä, Åbo, Finland

[73] Assignee: Aktiebolaget Electrolux, Stockholm, Sweden

[21] Appl. No.: 519,707

[22] Filed: Aug. 28, 1995

[30] Foreign Application Priority Data

Sep. 21, 1994 [SE] Sweden ..... 9403164

[51] Int. Cl.[6] ..... B21D 26/02

[52] U.S. Cl. ..... 72/60; 72/342.94; 72/709

[58] Field of Search ..... 72/54, 60, 342.94, 72/342.96, 709

[56] References Cited

U.S. PATENT DOCUMENTS

| | | | |
|---|---|---|---|
| 3,898,827 | 8/1975 | Swanson | 59/60 |
| 4,181,000 | 1/1980 | Hamilton et al. | 59/60 |
| 4,474,044 | 10/1984 | Leistner et al. | 72/60 |
| 4,936,008 | 6/1990 | Teresi et al. | 72/342.94 |
| 5,359,872 | 11/1994 | Nashiki | 72/342.94 |

FOREIGN PATENT DOCUMENTS

| | | | |
|---|---|---|---|
| 4309317 | 9/1994 | Germany . | |
| 608588 | 5/1978 | U.S.S.R. | 72/60 |
| 619255 | 8/1978 | U.S.S.R. . | |

*Primary Examiner*—David Jones

*Attorney, Agent, or Firm*—Pearne, Gordon, McCoy & Granger

[57] ABSTRACT

A method and an apparatus for forming details in a foil or plate material by means of superplastic forming, wherein the foil or plate material is heated over a selected localized area to a suitable temperature and simultaneously exposed to a fluid pressure so that the material is slowly deformed to a predetermined desired shape. Localized heating of the foil or plate is provided by guiding a laser beam (17) over the selected localized area of the foil or plate (12).

7 Claims, 1 Drawing Sheet

METHOD AND DEVICE FOR SHAPING DETAILS BY MEANS OF SUPERPLASTIC FORMING

BACKGROUND OF THE INVENTION

1. Field of the Invention

The present invention relates to a method and device for forming a detail by means of superplastic forming, wherein a foil or plate is heated to a suitable temperature and simultaneously exposed to a fluid pressure so that the foil or plate is slowly deformed to a predetermined shape.

2. Description of Related Art

It is previously known to use superplastic forming in order to shape details. The conventional method is described, for instance, in U.S. Pat. No. 4,181,000 the entire disclosure of which is expressly incorporated herein by reference. This patent discloses fixing a thin plate in a mold in which one mold part represents the shape of the finished detail. The plate is heated to a temperature which is considerably below the melting point of the material (usually 50–80% of the melting point measured in degrees Kelvin) while two opposite surfaces of the plate are simultaneously exposed to a comparatively limited pressure difference so that the material slowly, (i.e., over a period of 10 minutes to 2 hours), flows out and is pressed towards the mold part and achieves a corresponding shape. This prior art method has the advantage that when producing the detail only one mold part corresponding to the desired detail shape is needed. However, the prior art method suffers from the disadvantage that it is rather slow since the entire mold part and thin plate must be heated. It also requires a mold part, and replacement of the mold part with another mold part should a different shape be desired.

SUMMARY OF THE INVENTION

It is an object of the present invention to improve upon the previously described prior art technique by completely eliminating the need for a mold part having a form corresponding to the shape of the detail. This object is achieved by means of a device wherein heating of the plate is produced locally by means of a laser beam and simultaneous application of fluid pressure to a side of the plate results in the desired deformation.

The method according to the invention also saves time as compared to conventional superplastic shaping methods since the entire plate and mold need not to be heated.

BRIEF DESCRIPTION OF THE DRAWINGS

An embodiment of the invention will now be described with reference to the accompanying drawings, wherein.

DETAILED DESCRIPTION OF THE PREFERRED EMBODIMENT

Figure 1:
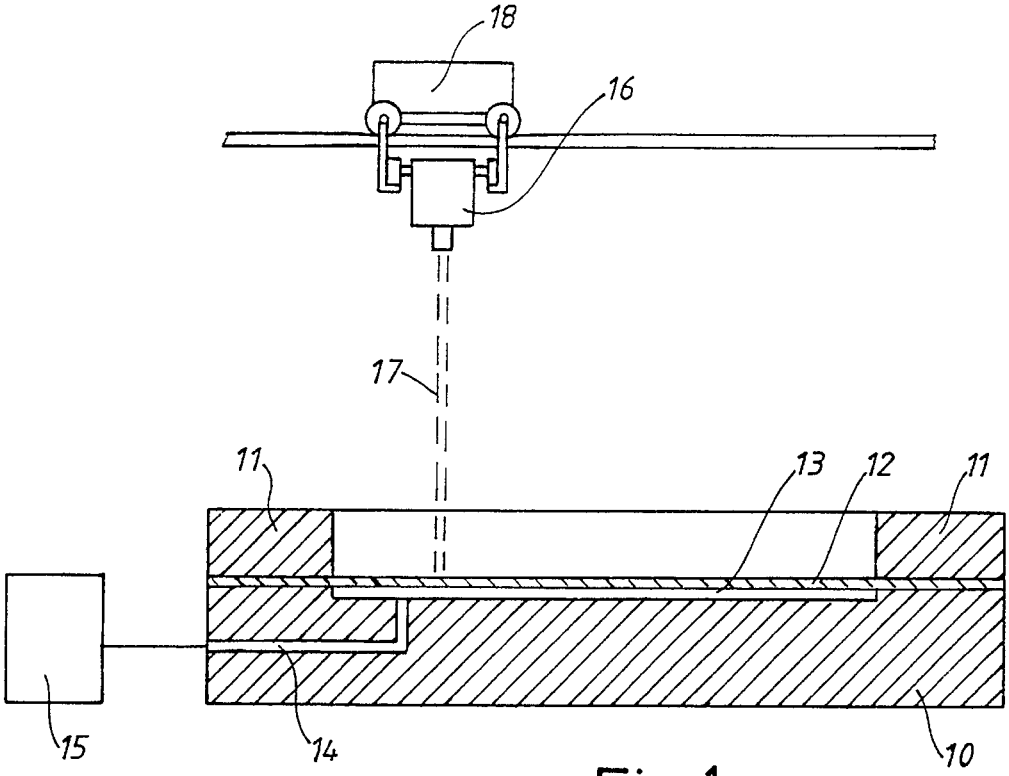
FIG. 1 is a vertical section through a device according to the invention before the shaping procedure takes place; and, FIG. 2 is a vertical section through the device according to the present invention during the shaping procedure.
Figure 2:
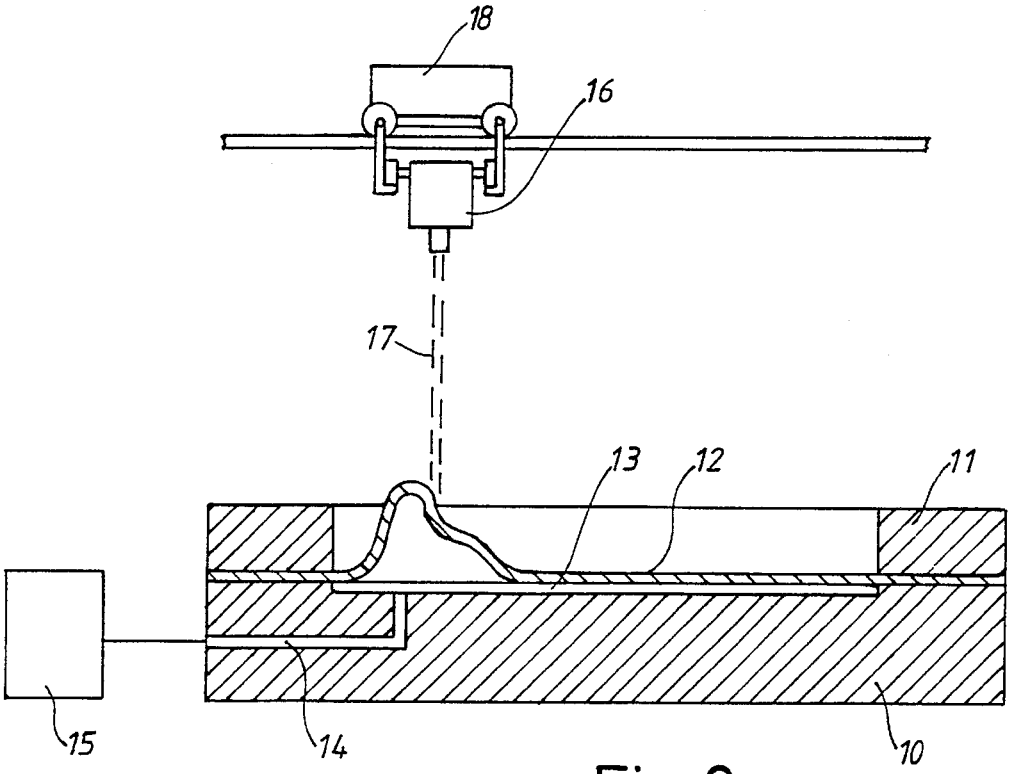

The device shown in the Figures comprises a table 10 having fastening means 11 for a foil or a plate 12 of a material suitable for superplastic forming. Such materials are well known in the art and include, for instance, zinc-, aluminum-, titanium-, steel-, and copper-alloys and certain ceramic materials. The thickness of the foil or plate 12 is preferably between about 0.01 to 5mm. Between the table 10 and the plate 12 a hermetically sealed chamber 13 is created which, via a passage 14, is connected to a pressure source 15 so that gas or liquid under pressure can be supplied to the chamber 13. The pressure in the chamber 13 can be set or controlled in a suitable way, preferably between about 2 to 30 bar.

Above the table 10 a laser source 16 is arranged so that a laser beam 17 emanating from the laser source 16 can be directed toward different areas on the plate 12. The laser source 16 is, for instance, supported on a carriage 18 which can be moved in a horizontal plane in two mutually perpendicular directions. The movement of the carriage 18 is preferably controlled by a microprocessor or microcomputer arranged on the carriage.

The device operates in the following way. A fluid under pressure is directed or supplied to the chamber 13 at the same time that a laser beam 17 is directed to a particular area of the foil or plate 12, causing a spot heating of the plate. Due to a predetermined movement of the carriage 18 and associated laser source 16 (which is controlled by the microprocessor), the laser beam 17 moves over the surface of a selected portion of the foil 12 which is thereby locally heated to a suitable temperature in order to permit the material to flow or deform outwardly under the influence of the pressure in the chamber 13. By choosing suitable time periods for the application of the laser beam on different areas of the plate 12 and, at the same time, having a suitable pressure in the chamber 13, the process can be controlled in such a way that the plate is deformed to a predetermined shape.

While the preferred embodiment of the present invention has been described herein, it is contemplated that numerous modifications, rearrangements, and substitutions of parts could be resorted to without departing from the scope and spirit of the invention as defined in the claims appended hereto. For example, it should be mentioned that it, of course, is possible to deform the plate 12 under the influence of vacuum or sub-atmospheric pressure in the chamber instead of using pressure above atmosphere.

It is also possible to apply different pressures on the opposed sides of the foil or plate whereby the pressure difference helps to deform the plate and thereby create the desired shaping. This, of course, means that an additional pressure or vacuum chamber has to be arranged on the upper side of the foil or plate 12 shown in the Figures, while the laser beam 17 could, for instance, reach the plate 12 via a window formed in a wall of the additional chamber. It is also possible to use a stationary laser source and direct the laser beam toward the working surface by means of mirrors and to control the mirrors and/or the fluid pressure in a suitable way according to a predetermined data program to create the desired deformation and shaping.

Therefore, the scope of the present invention is not to be limited to the preferred embodiment specifically described and illustrated herein, but rather is only defined by the claims appended hereto.

What is claimed is:

1. A method for forming details in a foil or plate material by means of superplastic forming, comprising the steps of:

guiding a laser beam over a selected portion of the material to thereby heat the selected portion to a temperature suitable for superplastic deformation; and, simultaneously exposing the material to a fluid pressure to thereby slowly deform the selected portion into a predetermined shape.

2. A method according to claim 1, wherein the laser beam is automatically guided and controlled by a microprocessor.

3. A method according to claim 1, wherein the foil or plate material has a thickness dimension of between about 0.01 to 5mm and is formed from zinc-, aluminum-, titanium-, steel- and copper-alloys or ceramic materials.

4. A method according to claim 1, wherein the selected portion is heated to between about 50 to 80% of the melting point of the material measured in Kelvin degrees, and the fluid pressure is between about 2 to 30 bar.

5. A method according to claim 1, wherein the material is exposed to fluid pressures on opposite sides thereof.

6. A device for forming details in a foil or plate material by means of superplastic forming, comprising:

means for holding the material in place;

means for creating a pressure differential between first and second sides of said material; and, a laser source for generating a laser beam, the laser beam being directed onto the material and heating a selected portion of the material to an elevated temperature, whereby the selected portion is slowly deformed under the influence of the pressure differential to a predetermined shape.

7. A device according to claim 6, further comprising a guiding system which directs the laser beam according to a predetermined data program.

* * * * *